US006125934A

United States Patent [19]

Lenn et al.

[11] Patent Number: 6,125,934

[45] Date of Patent: Oct. 3, 2000

[54] DOWNHOLE TOOL AND METHOD FOR TRACER INJECTION

[75] Inventors: Christopher Peter Lenn, London, United Kingdom; Bradley Albert Roscoe, Ridgefield, Conn.

[73] Assignee: Schlumberger Technology Corporation, Sugar Land, Tex.

[21] Appl. No.: 09/180,787

[22] PCT Filed: May 20, 1997

[86] PCT No.: PCT/GB97/01357

§ 371 Date: May 10, 1999

§ 102(e) Date: May 10, 1999

[87] PCT Pub. No.: WO97/44567

PCT Pub. Date: Nov. 27, 1997

[30] Foreign Application Priority Data

May 20, 1996 [GB] United Kingdom ..... 9610574

[51] Int. Cl.[7] ..... E21B 47/00

[52] U.S. Cl. ..... 166/250.12; 166/250.07; 73/152.29

[58] Field of Search ..... 166/250.07, 250.12, 166/213; 73/152.18, 152.29, 152.31; 250/259, 260

[56] References Cited

U.S. PATENT DOCUMENTS

| | | | |
|---|---|---|---|
| 2,564,198 | 8/1951 | Elkins | 73/152.28 |
| 2,738,019 | 3/1956 | Atkinson | 166/241.7 |
| 4,166,215 | 8/1979 | Anderson | 250/260 |
| 4,166,216 | 8/1979 | Cubberly, Jr. | 250/260 |
| 4,223,727 | 9/1980 | Sustek, Jr. et al. | 166/250.03 |
| 4,622,463 | 11/1986 | Hill | 250/259 |
| 4,805,450 | 2/1989 | Bennett et al. | 73/152.29 |
| 4,861,986 | 8/1989 | Arnold | 250/260 |
| 4,966,233 | 10/1990 | Blount et al. | 166/162 |
| 5,047,632 | 9/1991 | Hunt | 250/302 |
| 5,282,492 | 2/1994 | Angeli | 137/493.4 |
| 5,306,911 | 4/1994 | Hunt | 250/302 |
| 5,441,110 | 8/1995 | Scott, III | 166/308 |
| 5,543,617 | 8/1996 | Roscoe et al. | 250/259 |
| 5,631,413 | 5/1997 | Young et al. | 73/152.29 |

FOREIGN PATENT DOCUMENTS

| | | | |
|---|---|---|---|
| 0 400 707 | 12/1990 | European Pat. Off. | G01F 1/704 |

*Primary Examiner*—David Bagnell
*Assistant Examiner*—Jennifer R Dougherty
*Attorney, Agent, or Firm*—William B. Batzer

[57] ABSTRACT

An injection apparatus and use thereof that comprises a plurality of spaced ejection ports from which the tracer composition can be ejected so as to be injected directly into a chosen layer of a stratified flow, and that in use can be adjusted such that the ports lie each within the appropriate layer. Each port is connectable to a source of tracer composition and most conveniently the source is the combination of a reservoir and a syringe-like device which can draw a suitable amount of the composition from the reservoir and then drive it to, and eject it from, the associated port into the chosen layer.

9 Claims, 12 Drawing Sheets

DOWNHOLE TOOL AND METHOD FOR TRACER INJECTION

This invention relates to a downhole flow monitoring tool, and concerns in particular a tool for the downhole injection of one or more tracer or marker materials into a flowing multiphase fluid in a hydrocarbon well, for subsequent detection downstream of the injection point.

BACKGROUND OF THE INVENTION

When a well, specifically an oil or gas well, has been completed and is yielding the desired product it is necessary to monitor the well's performance to ensure that it is behaving as expected. In particular, it is desirable to measure the rate at which the well's products—in an oil well, for example, these would be oil, water, gas or a combination, even a mixture, of all three—are flowing along the borehole and up to the surface, and it is generally desirable to monitor the flow velocities actually down the well itself rather than merely when they reach the surface. Many types of method and apparatus have been proposed for this purpose; two typical such involve firstly the use of a mechanical "spinner" and secondly the use of tracer or marker materials. In the spinner case a wireline-supported tool carrying a small propeller- (or turbine-) driven dynamo is placed in the flowing fluid so that the propeller is turned around by it, and the dynamo's output indicates the flow velocity. In the tracer/marker case there is used an injector/detector tool, by which a suitable material—for example, a detectable chemical or a radioactive substance—is injected into the fluid, and its arrival time at a downstream detector station is noted, giving the flow velocity by a simple distance-over-time calculation. Spinners work satisfactorily in borehole sections that are vertical, but not nearly so effectively in sections which are horizontal—it is common these days for a well to include a section driven horizontally through the underground geological formation delivering the sought-after product—for in such a section the well fluid is liable to be stratified into individual component layers (with the heaviest, such as water/brine, on the bottom, the lightest, such as methane gas, on the top, and any others, such as oil, in the middle), and these layers are not necessarily flowing at the same speed. A spinner placed in the borehole across two differently-flowing layers is therefore likely to output a signal which is at best some sort of average, and is at worst quite meaningless. For fluid flow velocity measurement in horizontal wellbore sections, therefore, it has been suggested that there should be employed tracer/marker materials and the appropriate injector/detector tools, and it is with this that the present invention is concerned.

There are many specific techniques utilising tracer/marker materials. For example, in a group of methods that might be referred to as "nuclear" there can be involved: radioactive substances, and detecting the radiation they emit; activatable substances, that on exposure to a radiation source become unstable, and detecting their decay products; neutron-absorbing substances, and detecting the fall in received neutrons from a source as the tracer passes by; and X-ray-absorbing (that is, dense) substances, and detecting the way they modify the radiation received from some appropriate X-ray source. Numerous techniques and materials have been previously proposed in the literature for use in monitoring flows in oil wells, and reference is made to the patents and technical literature.

However, regardless of what specific technique is employed, there remains the problem of measuring the flow velocity of the desired component of the wellbore fluid, and in part this is usually done simply by preparing the tracer/marker material that is significantly more soluble—or, at least, more miscible—in the chosen component than it is in the other(s). Thus, for monitoring a well's water/brine output the selected material is conveniently formulated as an aqueous solution, while an oil-miscible composition is used if it is the well's oil output that needs to be observed. All that is then left is for the tracer/marker composition to be inserted into the well fluid at the selected part of the horizontal section in such a way that it ends up in the desired component layer, and in the past this has been achieved merely by introducing the composition into the fluid somewhere across the borehole, and allowing it to migrate to its intended target. Thus, if injected into the bottom, aqueous layer, an aqueous tracer composition naturally stays there, while an oil-soluble composition is immiscible with (and lighter than) this bottom water layer and might be expected to rise up to and through the water/oil interface and so into the targeted oil layer. And, in theory, vice versa; injected into the upper, oil layer the oil-miscible composition stays there, while the water-based one migrates across the interface into the bottom, aqueous layer.

Unfortunately, and despite what seems to be accepted wisdom in the published literature about the theory of this technique, the Applicants have discovered through laboratory experiments that in practice the passage of the composition through the interface is in either case extremely difficult if not actually impossible, and that the assumptions made in this field about tracer migration in a miscible phase are simply, and unexpectedly, wrong. More specifically, either the passage of the composition through the interface is subject to some indeterminate delay or, and worse, the composition, having passed through the interface, is poorly (if at all) absorbed into the component. This is especially so if the composition materials can themselves become particulate and coated with the wrong (in this case, aqueous) layer component; as will be appreciated, such a delay , or such a poor absorption, causes either the flight time or the concentration of the tracer between injection and detection points to be unrepresentative of the speed or volume of the selected layer, and thus the estimated flow velocities/rates of the respective fluid phases can be substantially incorrect. The problem is discussed further hereinafter with reference to FIGS. 4*a–h* of the accompanying Drawings.

As might be expected, it is not normally acceptable to monitor the flow velocity of only one component layer in a horizontal borehole section, for much useful information can be gained by effectively simultaneously looking at all the layers. Nor is convenient to make use of tracer-injection equipment that has to be orientated one way for injecting the tracer composition into one layer and then re-oriented before it can be used to inject a second tracer composition into a second layer. It is therefore highly desirable to employ means for introducing the relevant tracer compositions that can, without intermediate re-orientation, in fact inject two (or more) different layers with the relevant tracer compositions, and even be able to inject them simultaneously. It is such a flow-monitoring, injection tool that the invention proposes. More specifically, the invention suggests an injection tool that comprises a plurality of spaced ejection ports (from which the relevant tracer composition can be ejected so as to be injected into the relevant chosen component layer), together with orientation means whereby in use the orientation of the tool can be so adjusted that the ports are so disposed as concurrently to lie each within the appropriate layer. Naturally, each port will be operatively connectable to a source of the relevant tracer composition from which will in use be supplied the amount to be injected; most conveniently the source will be the combination of a reservoir and a syringe-like device (which latter can draw a suitable amount of the composition from the reservoir and then drive it to, and eject it from, the associated port into the chosen layer).

SUMMARY OF THE INVENTION

In one aspect, therefore, the invention provides a downhole flow-monitoring tool for monitoring the flow of fluid within a borehole, the tool including an injector for injecting a tracer or marker material into a flowing fluid in a first borehole region, and means for detecting said tracer or marker material in the flowing fluid at a second downstream borehole region, wherein said injector comprises:

a main body positionable in use within the borehole;

first means for injecting the material through an ejection port positioned in use at one side circumferentially of the borehole; and second means for injecting the material through another ejection port positioned in use at the opposite side circumferentially of the borehole.

In an alternative version of this same aspect, the invention may be viewed as an injection tool, for use in the monitoring of the flow velocities of the stratified components in a horizontal section of a well such as an oil well, which injection tool is for injecting into each of the chosen component layers a tracer/marker composition, and which tool includes a plurality of spaced ejection ports, at least one for each chosen component layer, together with orientation means whereby in use the orientation of the tool can be so adjusted that the ports are so disposed as to lie each within the appropriate layer, and wherein each port is operatively connectable to a source of the relevant tracer composition.

Though it may of course have other applications, the injection tool of the invention is primarily for use in the monitoring of the flow velocities of the stratified components in a horizontal section of a well. As noted above, the well may be any sort of well, but will typically be an oil well, the well fluid components thus being mainly water (usually in the form of brine), oil and gas (mostly methane). Moreover, although the injection tool is described as being of use in the monitoring, and measurement, of flow velocities, it can have other uses. For example, given a knowledge of the initial injected volume and of the diffusivity (k) of the tracer composition within the chosen component layer, then the actual volumetric flow rate of the layer can be determined from a knowledge of the concentration of the tracer at the point of detection (and this concentration can itself be determined from a measurement of the amplitude of the detected signal).

The invention relates to monitoring the flow velocities of the stratified components in a horizontal section of a well; as will be fully understood by those versed in the Art, such a "horizontal" section may but will usually not be exactly horizontal, and the invention applies in essence to any wellbore section that has the fluid flowing in it in stratified, or layered, form. Such layered flow can be experienced when the borehole is deviated at an angle—up or down—of five, ten or even more degrees to the horizontal.

Depending on the nature of the tool string of which the injection tool of the invention is a part, the tool may be a "centred" tool—one designed to be positioned roughly axially in the borehole—or it may be an eccentred tool—one designed to be positioned eccentrically in the well alongside the well casing/borehole wall (and most conveniently sitting on the bottom of the borehole).

The invention provides an injection tool for injecting into each of the chosen component layers a tracer/marker composition. The composition, and the nature of the tracer or marker material within it, may take any of the forms used or proposed for use in the Art—a number of these have been noted hereinbefore—and no more need be said about them here.

The tool of the invention includes a plurality of spaced ejection ports out of which the appropriate tracer/marker material can be ejected for injection into the relevant wellbore fluid component layer. There are obviously at least as many ports as there are layers that are required to be monitored—thus, a minimum of two (for two layers), and perhaps three or even more—and they are spaced so that, when the tool is properly orientated within the borehole, each port is in the layer to which it relates, and thus that the tracer/marker composition ejected therefrom is injected directly into the correct layer. The actual spacing will, of course, be appropriate to the particular circumstances—thus, the diameter of the borehole, and whether the tool is centred or eccentred. For a typical 7 inch (17.5 cm) oil well completion pipe, for instance, the spacing of the ports in an eccentred injection tool might be around 5 inches (12 cm), while for a centred tool the spacing might be 2.5 in (6 cm).

The injection tool includes at least one ejection port for each chosen component layer. It may be desirable—so as to permit a greater amount of tracer/marker composition to be injected in one go—for each layer to have two, or even more, associated ports. In one preferred two-phase fluid oil well embodiment there are two ports associated with the water layer but only one for the oil layer.

Some or all of the ejection ports are preferably fitted with two-way relief valves to prevent a backflow of borehole fluid into the ports (unless this is required for pressure relief), and to prevent leakage of tracer material.

The invention provides an injection tool which includes a plurality of spaced ejection ports. Of course, the tool has a body, and the ports are in effect apertures in the body (and, as stated, each of these is operatively connected to a source of the relevant tracer/marker composition). However, while each port might be merely an aperture in the body, it is preferred, to keep the body small (as discussed below) and yet have the several ports appropriately spaced, if the or each port for at least one of the chosen layers be provided with an extension in the form of a narrow, elongate tube, through which tube the composition is delivered to the free end at which it is ejected from the tube and so injected into the layer; in such a case it is in effect the free end, or nozzle, of the tube that constitutes the ejection port, and it is the free end that is spaced from the other port(s). It is, of course, possible for the port(s) for each of the chosen layers to incorporate such an extension tube, and in one preferred embodiment such is the case.

The injection tool of the invention has, as just noted, a body in which apertures constitute the ports through which the trace/marker material is to be ejected, which apertures may have tube-like extensions. This body may be in one or more portions, each portion carrying one or more of the port-defining apertures, as required. Indeed, in one particularly-preferred embodiment of the invention the body is in two very similar—substantially identical—portions each of which carries one of two tubular-extension-utilising ports from the free, nozzle, end of which the tracer material is injected into the relevant fluid component layer (as just described above), and the two portions are arranged sequentially along the tool and each so orientated relative to the other that its tube-extended port has the free end located in the layer of interest. Moreover, and as shown in the embodiment discussed further hereinafter in connection with the accompanying Drawings, it is very convenient if each portion be, in fact, a "single-bodied" injection tool of the invention—with two ports one of which has an operative tubular extension reaching into the component layer of interest and the other of which is an unextended aperture in the body and is actually blocked off (and so is inoperative)—the two tools being effectively identical (save for the choice of port to be utilised) and arranged front-to-back linearly to form the whole tool. Having two "identical" body portions in this manner tends to facilitate the supply of the relevant tracer/marker material from a reservoir thereof via a suitable pump mechanism to the port (the use of reservoirs and pumps is described further hereinafter). The tool of the invention may, for convenience, be discussed herein as though it had a single body portion, but it will be understood that where appropriate the remarks are also intended to refer to tools with two (or more) body portions.

As intimated above, the tool—and specifically the body of the tool—should be small (in cross-section; it can be quite long, however) in relation to the size of the borehole, and this is so that it does not significantly occlude, or block, the borehole (for that would artificially reduce the flow of the various well fluids, and so result in "false" readings).

The invention's tool includes orientation means whereby in use the orientation of the tool can be so adjusted that the ports are disposed such that each lies within the appropriate layer. There are two such orientations that need to be taken into account; one is the spatial orientation—the ports need to be positioned appropriately across the width of the borehole—while the other orientation is angular—for a well fluid stratified into horizontal layers the ports naturally need to be disposed vertically, so that one is in a lower stratum while another is above it, in an upper stratum. The first of these—spatial orientation—may conveniently be achieved by providing the tool with spacer elements that in use effectively stretch across the borehole, and by locating the ports relative to those spacer elements such that when in position the ports will necessarily be appropriately disposed across the borehole. The spacer elements can be made adjustable, so that they permit the tool to fit inside differently-sized boreholes (and to pass through minor constrictions in a borehole), and the location of each port relative to the spacer elements can be adjustable, to allow for use in wells where the component layers are of different depths. A very convenient form of spacer element is a bow-shaped spring—a bow spring—attached at one end to the tool and extending out and away therefrom and then curving back toward the tool (where it may either be completely free or it may be coupled to the tool in such a way as to permit it to move axially relative to the tool); the flexibility of the spring, coupled with one end of it being axially free (and floating axially relative to the tool) means that it will adjust itself automatically to place the tool within a roughly predetermined position across the borehole regardless (again within limits) of the actual width of the borehole. With such a bow spring spacer element it is advantageous to employ a port with a tubular extension, as mentioned above, and to arrange for that extension to run up the bow spring from the fixed end to a point therealong—conveniently at the midpoint of the bow—at which the tube's nozzle, and thus the effective ejection port aperture, is located. Then, as the bow spring flexes in and out to adjust to different borehole widths, so the ejection port simultaneously moves in and out to stay located within the relevant chosen layer.

With one such bow-spring-plus-port-extension spacer element the tool will be an eccentred tool, with its body and one port disposed alongside the borehole wall and with a second port positioned spaced therefrom and adjacent the centre of the bow. However, in another preferred embodiment of the invention there are at least two such bow springs, extending in opposite directions, each with an associated port extension tube and nozzle; such a tool would be a centred tool, with its body lying in use near the axis of the borehole, and its two ports disposed one near each opposed wall. If it is necessary to centre the body more definitively then it would be possible to have three (or more) bow springs so disposed angularly relative to each other that they provide a more forceful centralisation (three bow springs would be at 120° to each other, four at 90°, and so on).

So far as concerns the angular orientation of the tool and its ports, it is possible to utilise some sort of driven, "motorised" orientation system, perhaps associated with a detector device for determining when the tool is correctly orientated (or when one or other port is actually in the relevant chosen layer). However, a simpler, and presently-preferred, way of achieving the necessary orientation is simply to weight the tool eccentrically, so that it orientates itself suitably under gravity (and as appropriate it might be the injection tool itself that is so weighted or it might be some other part of the associated tool string to which the injection tool is fixed in orientation). In such a preferred embodiment using a single bow spring spacer element the tool has an elongate rod-like body to which the bow spring is mounted by way of a loose collar, or "shuttle" disposed around the body. Each end of the bow spring may be mounted to the body by such a shuttle, and to locate the spring lengthwise of the body it is convenient to have one such shuttle keyed to the body, preventing axial movement while permitting angular movement, while the other shuttle can move freely in both senses. In a case where there is one bow spring carrying one ejection port extension and the other port(s) is in the tool body, the weight of the body will in use cause it to lie on the bottom surface of the horizontal borehole section, in the bottom component layer, while the bow spring projects up into the upper component layers; the rotatable nature of the bow spring mounting (the shuttle) means that the tool will always adopt this orientation no matter how it may first be disposed within the borehole. However, in a centred tool case using two or more bow springs disposed around the tool, and where the tool's orientation is fixed relative to some other part of the complete tool string, there may be no need for such relatively complicated shuttle mountings, and instead the spring may be fixedly secured (at one end, at least) to the tool body.

In the injection tool of the invention each ejection port is operatively connectable to a source of the relevant tracer composition—that is to say, each port has leading thereto a channel, conduit, tube or other suitable passageway along which the relevant tracer/marker composition can be fed to the port for ejection therefrom, and this channel can be connected to a reservoir for that composition, in which reservoir the composition can be stored ready for use, and from which it can be delivered—under pump pressure, say—to the channel and thus to the port. Each channel, or the like, may take any suitable form; in a preferred embodiment it is a simple conduit fashioned within the body of the tool.

In the cases where the tool is associated with a spacer element in the form of a shuttle-mounted bow spring, and there is a ejection port with an extension tube running along the bow spring, it will clearly be necessary to arrange suitable means whereby the relevant tracer/marker composition can be fed from the "stationary" ejection port in the body of the tool to the moveable in-board end of the extension tube. This can be effected using conventional means, such as surface arcuate channel portions in one of the body and shuttle associated with radial conduits in the other, and with sealing O-rings to prevent leakage of the composition between body and shuttle, and an embodiment of this is discussed further hereinafter with reference to the accompanying Drawings.

As just noted, each ejection port is operatively connectable to a source of the relevant tracer composition from which it can be delivered—under pump pressure, say—to the port. Because the accuracy of this type of tracer/marker flow monitoring technique depends to a considerable extent on providing for the detection and measurement a short, "sharp", well-defined pulse of the tracer/marker material, it is highly desirable to eject the material into the flowing well fluids in one burst, and a fast-acting mechanism is necessary to achieve this. For use with the tool of the invention, then, it is very much preferred to employ for each ejection port a spring-loaded syringe both as the (small) primary tracer/marker reservoir and as the pump, which syringe, once loaded with composition, can be triggered to drive the composition to, and eject it from, the relevant port in the desired one short burst. However, since it may be desired to make a number of sequential flow measurements at any one site, or even to make some measurements at one site and then to move the tool to, and take measurements at, another, and because it may be difficult in a controlled manner to arrange for only a part of the syringe's contents to be squirted out each time, it is highly desirable to provide for each port a larger secondary, or storage, reservoir from which the syringe can be re-filled for each subsequent use. And to enable the syringe to withdraw composition from this storage reservoir it is convenient to provide the syringe with a motorised or spring-poweredplunger and suitable one-way-valved connections to the reservoir and to the ejection port. In a particularly preferred embodiment the amount of composition drawn into the syringe may be varied in accordance with the circumstances, so as to deliver a larger or smaller burst into the chosen layer as may be required.

The injection tool of the invention is for use in a flow monitoring system in which a suitable composition is injected into the chosen layer of the flowing well fluid and then detected, by one means or another, at some distance downstream from the injection point. The detection means may form an integral part of the injection tool—with an elongate tool the ejection may take place at one end, the detection at the other—but apart from noting that detection may be accomplished in any way appropriate to the tracer/marker materials being used the matter need not be discussed further here.

The downhole injection tool of the invention is intended to be used in a downhole flow-monitoring system for a deviated or horizontal well where the well fluid is stratified, so that a suitable composition can be injected into the chosen layer(s) of the flowing fluid and then detected, by suitable equipment, at some distance downstream from the injection point. In another aspect, therefore, the invention provides a method of measuring downhole the flow velocities of selected phases of a multiphase fluid in a deviated or horizontal borehole, in which method a downhole flow monitoring tool of the invention is positioned within a deviated or horizontal portion of the borehole and employed both to inject a first tracer or marker material in a first fluid phase located adjacent the bottom circumferential side of said borehole, said first material being selected to be a material miscible in said first fluid phase, and also—and without re-orientation—to inject a second tracer or marker material in a second fluid phase located adjacent the upper circumferential side of said borehole, said second material being selected to be a material miscible in said second fluid phase, and in which method there is then measured the time taken for each tracer/marker material to pass a known distance along the borehole, this time/distance information then being utilised to calculate the required flow velocities

BRIEF DESCRIPTION OF THE DRAWINGS

Various embodiments of the invention are now described, though by way of illustration only, with reference to the a accompanying Drawings in which:

FIGS. 2A–D show details of the tool of FIG. 1 (FIGS. 2A–C fit together, end to end, to show the whole tool, while FIG. 2D shows details of one of the shuttles employed)

DETAILED DESCRIPTION OF THE INVENTION

Figure 1:
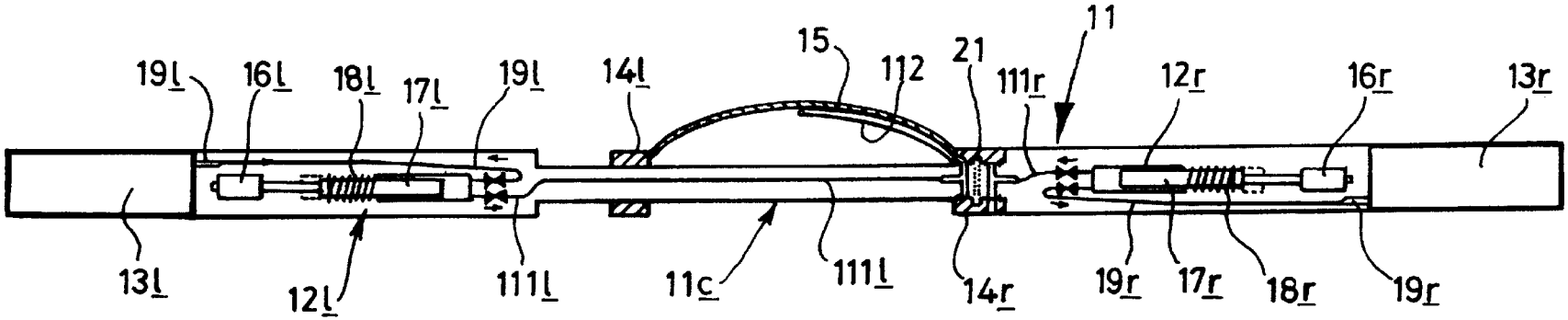
FIG. 1 shows in cross-section a complete injection tool according to the invention.
Figure 2A:
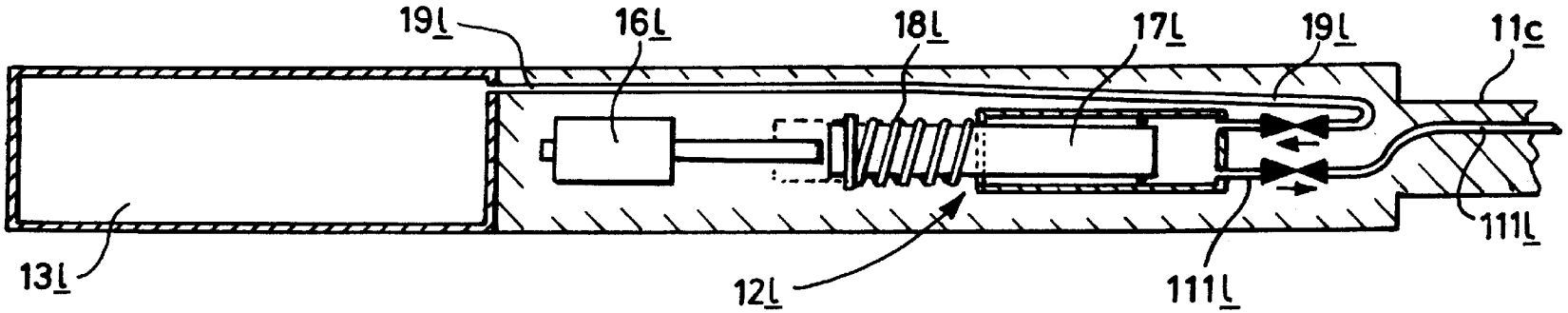
Figure 2B:
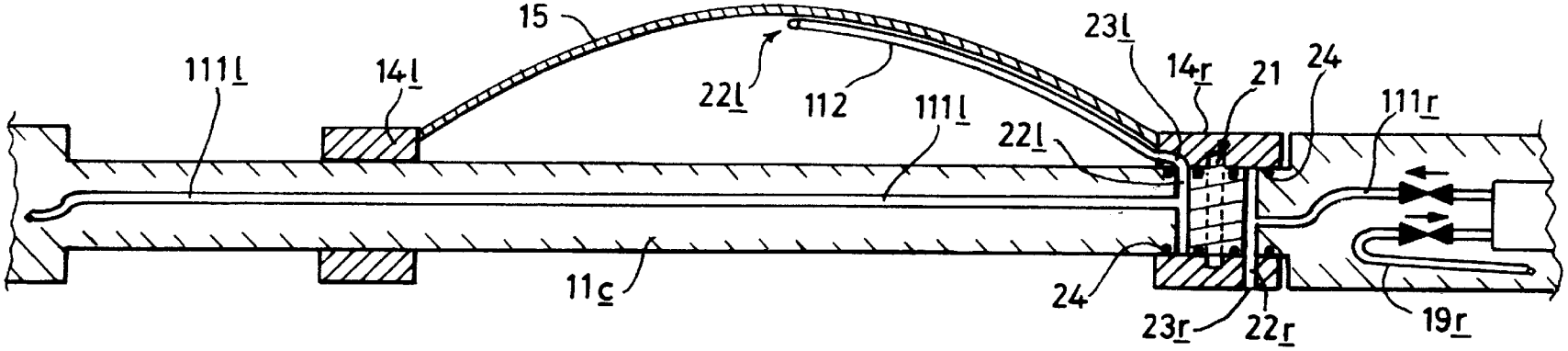
Figure 2C:
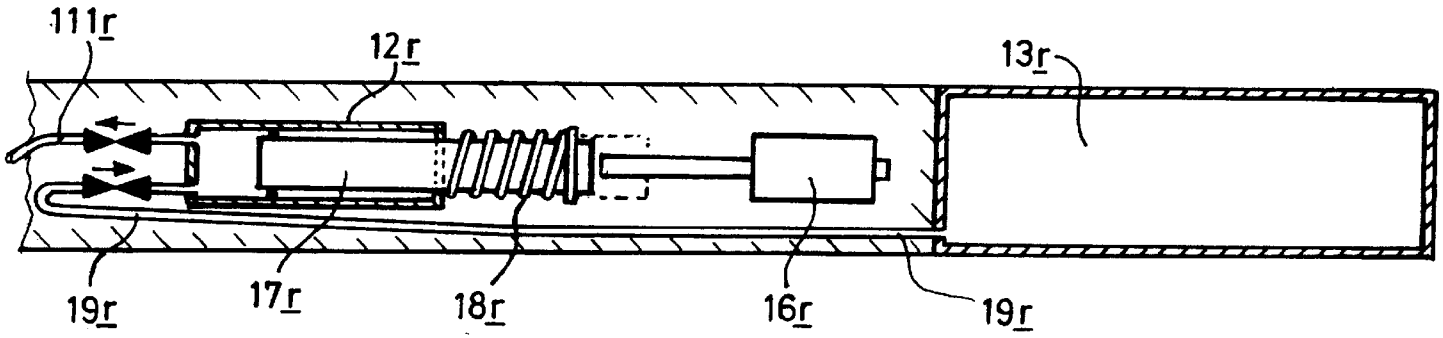
Figure 2D:
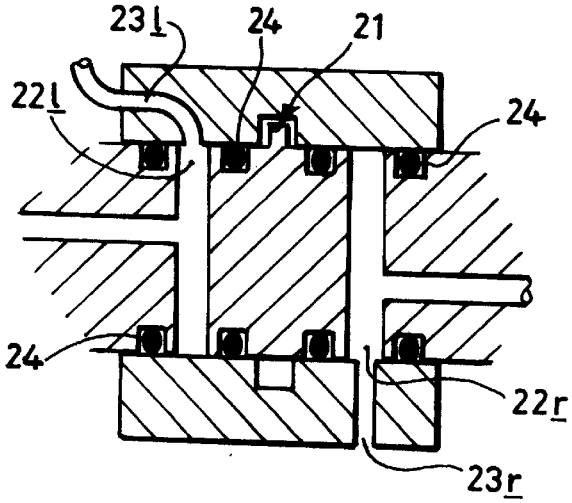

The injection tool shown in FIGS. 1 & 2 has an elongate, rod-like body (11) with an injection pump, or syringe (12*l*, 12*r*) and associated tracer/marker composition storage reservoir (13*l*,13*r*) at either end (the individual components are shown in more detail in FIGS. 2A–D). In the centre is a narrower portion (11*c*) carrying two collar-like shuttles (14*l*,14*r*); one of these, 14*r* on the right as viewed, is able to rotate around the rod but is keyed (21 in FIGS. 2B & D) to prevent it moving axially, while the other, 14*l* on the left, may both rotate and move axially. Attached at each end to one of the two shuttles 14*l* and 14*r* is a bow spring (15).

Each syringe 12*l* and 12*r* has an associated motor (16*l*, 16*r*), which drives the plunger (17*l*,17*r*) against a spring (18*l*,18*r*) that can, when the syringe is triggered (by means not shown) rapidly drive the plunger 17*l* and 17*r* down to empty the syringe of its contents. The motor 16*l* and 16*r* withdraws the plunger 17*l*, and 17*r* causing the syringe to fill itself by drawing tracer/marker composition along a one-way valved conduit (19*l*,19*r*) from the associated reservoir 13*l*, and 13*r* while when triggered the spring-driven plunger forces the syringe's contents out along another one-way valved conduit (111*l*,111*r*); the left (as viewed) one of these extends through the central tool section 11*c* to near the other end. Each such output conduit 111*l* and 111*r* feeds composition to a port (22*l*, 22*r*: see FIG. 2D) linked to a corresponding port/passage (23*l*, 23*r*) in the right-hand, axially-fixed shuttle 14*r* (this is sealed to the rod 11*c* by a number of O-rings 24); one of these port/passages 23*l* and 23*r*—in this case, 23*r*—is open directly to the borehole space and fluid surrounding the injection tool, while the other, 23*l*, is fitted with an extension tube (112) that follows the curve of the bow spring 15 up to the mid point thereof, and then ends in a valved nozzle (not shown separately).

Figure 3A:
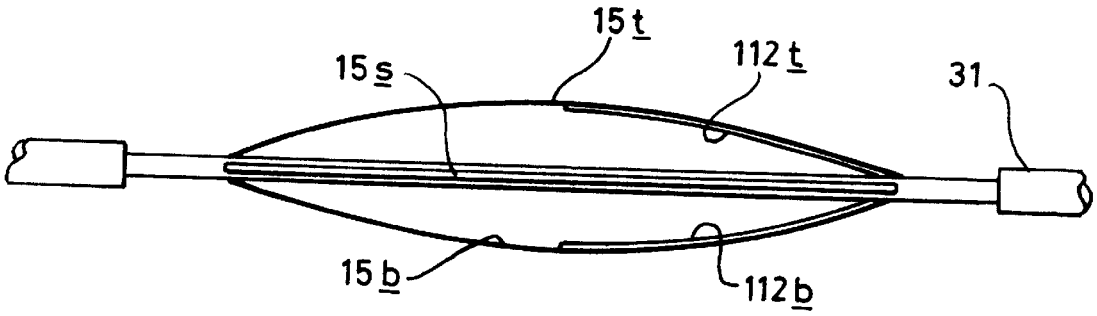
FIGS. 3A&B show two different alternative tools of the invention.

The injection tool embodiment shown in part in FIG. 3A is in many ways similar to that of FIGS. 1 and 2, save that it is a centred tool, and has four bow springs (three—15*t*,

15*b*, 15*s*—are visible), spaced around the body. Two of them—15*t*,15*b*—each have an ejection port extension tube (112*t*, 112*b*), so that in use the tool sits with its body (31) roughly coaxial of the borehole, one bow spring and tube 15*t*, 15*b*, and 15*s*; 112*t* and 112*b* at the top and the other at the bottom.

Figure 3B:
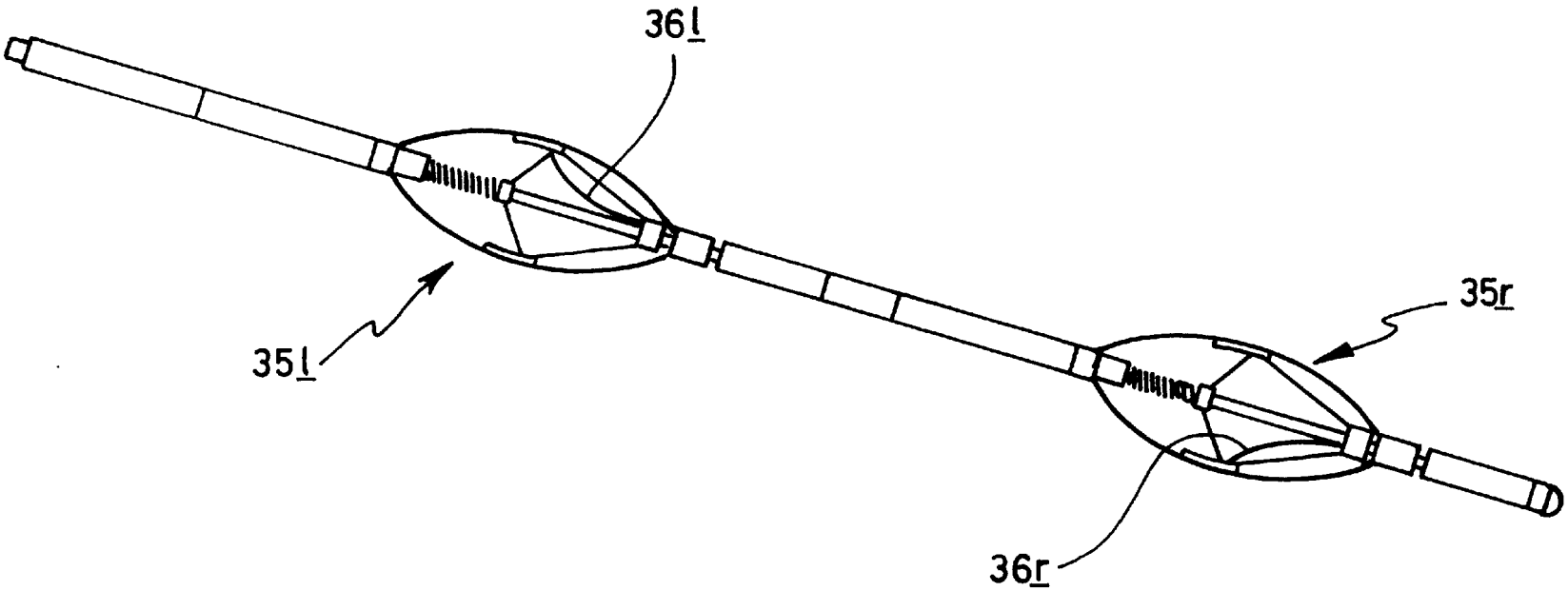
Figure 4A:
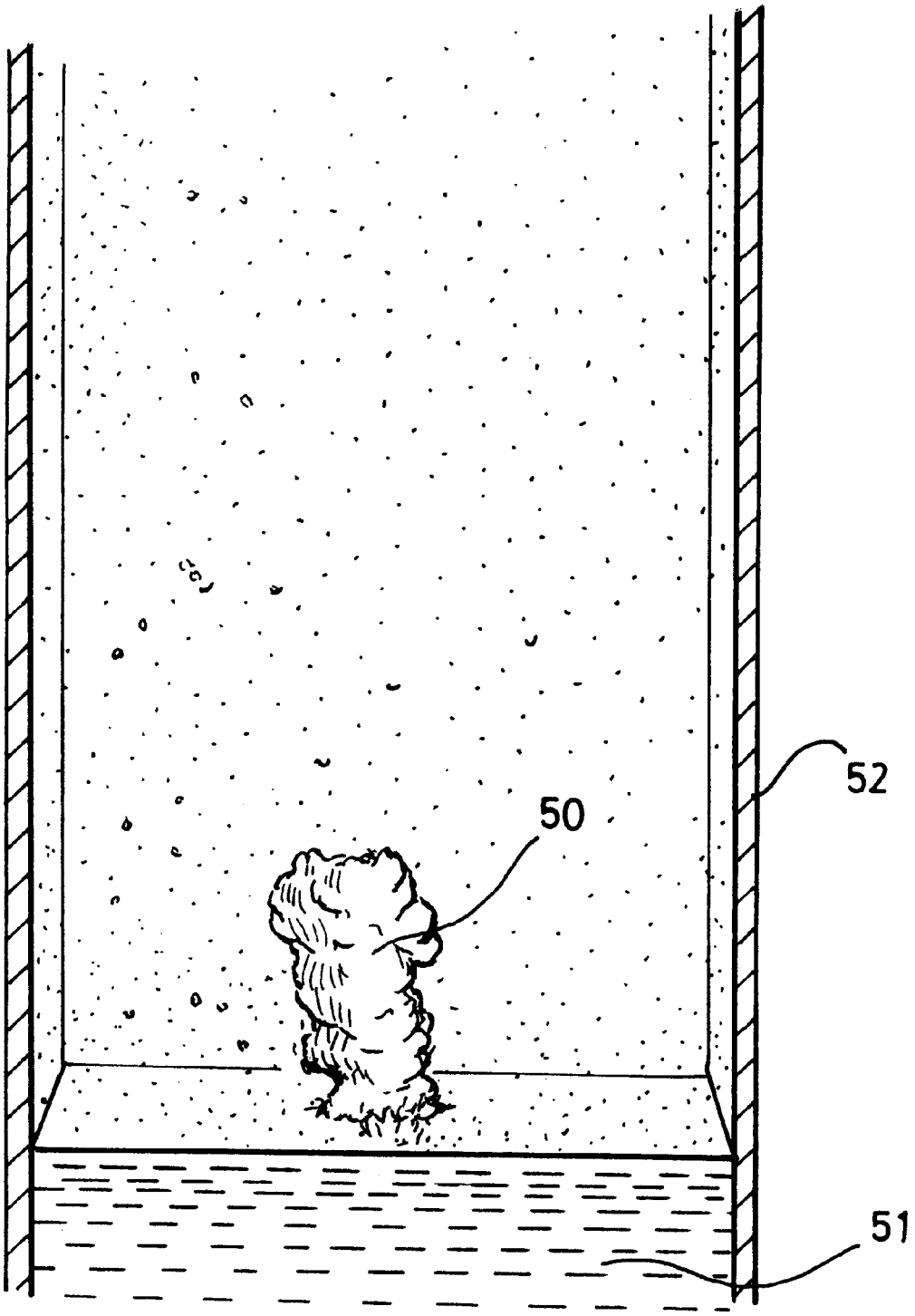
FIGS. 4*a–h* relate not to the tool of the invention but instead to results of laboratory experiments of a marker material being injected through a water/oil interface.
Figure 4B:
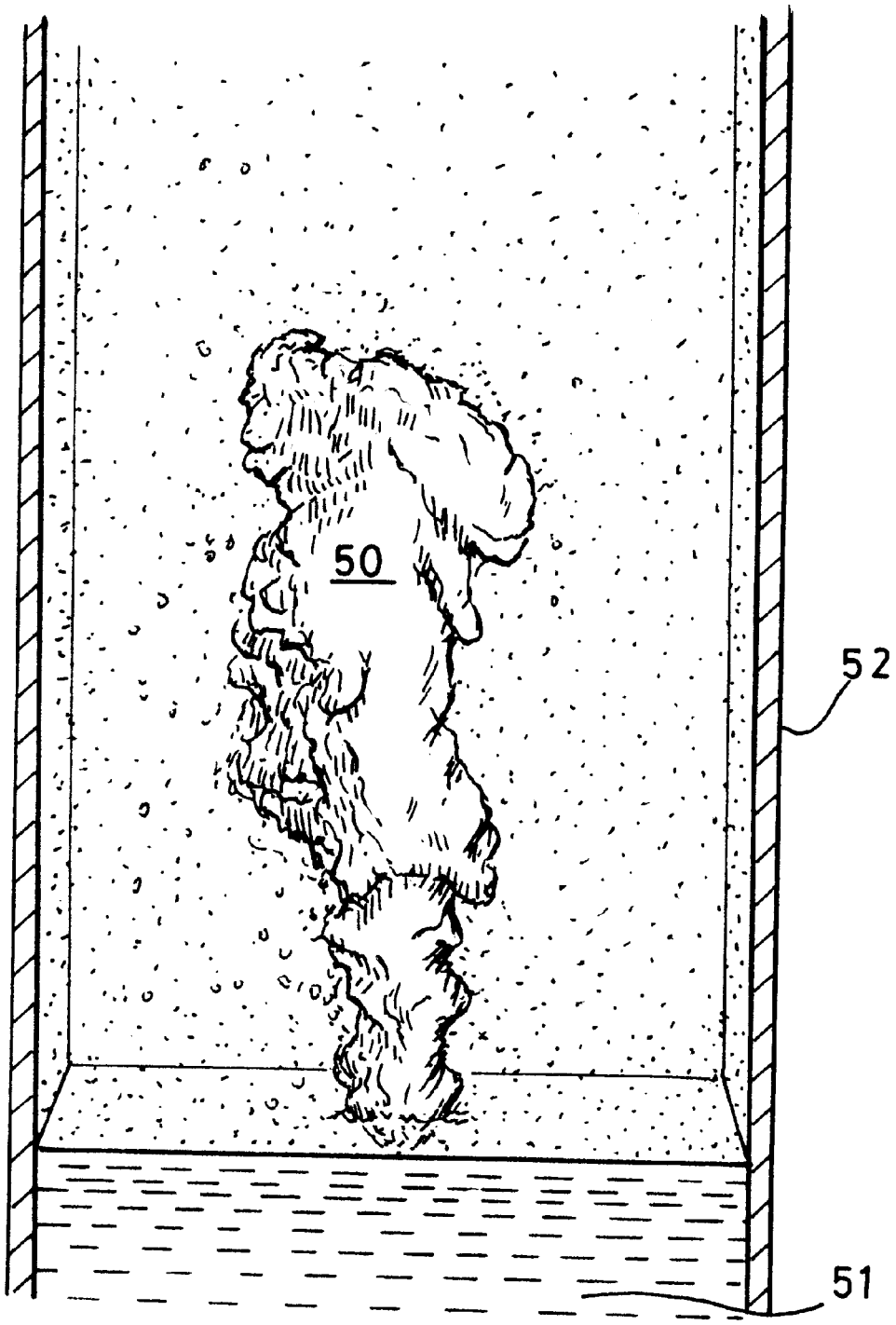
Figure 4C:
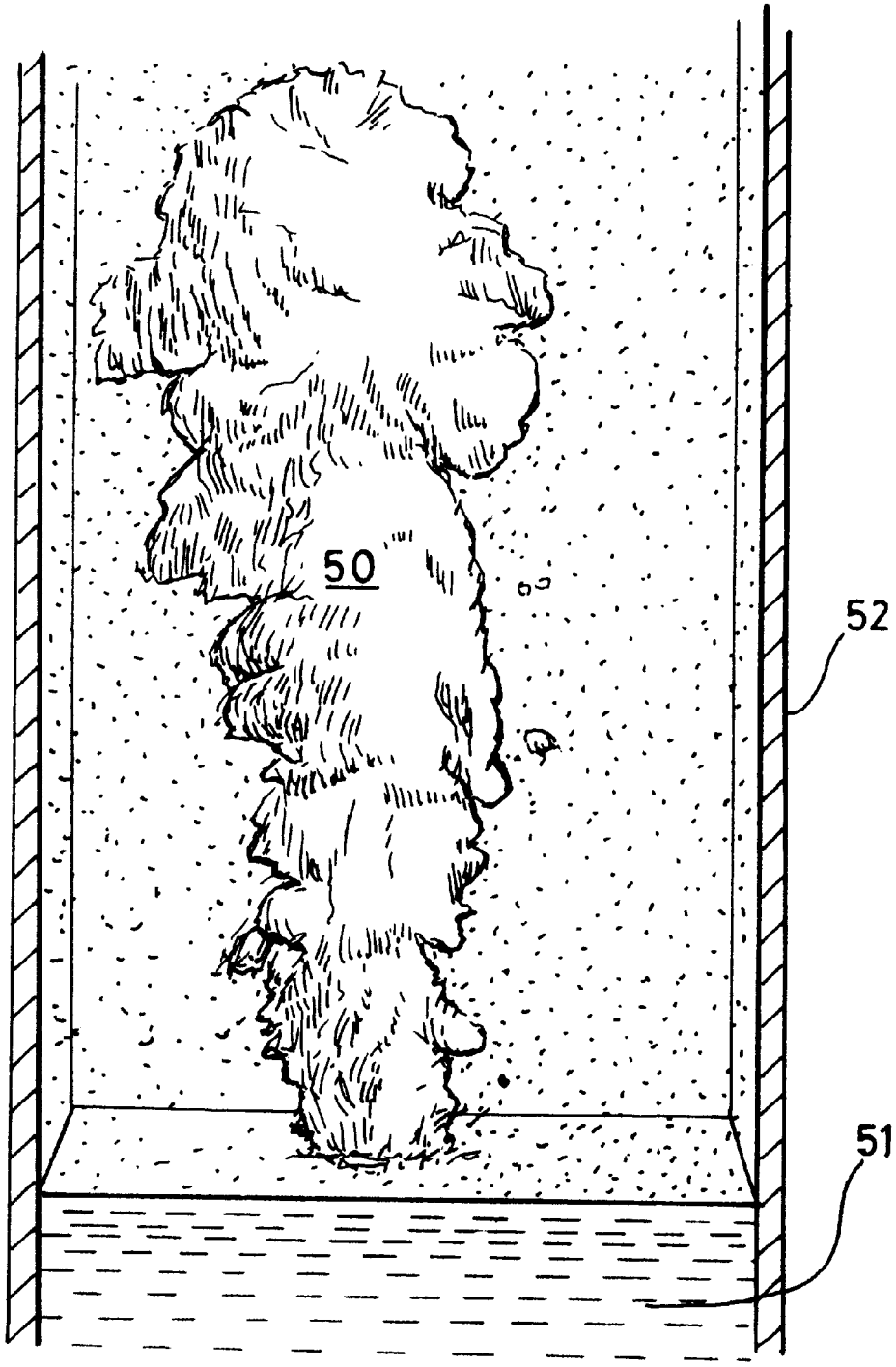
Figure 4D:
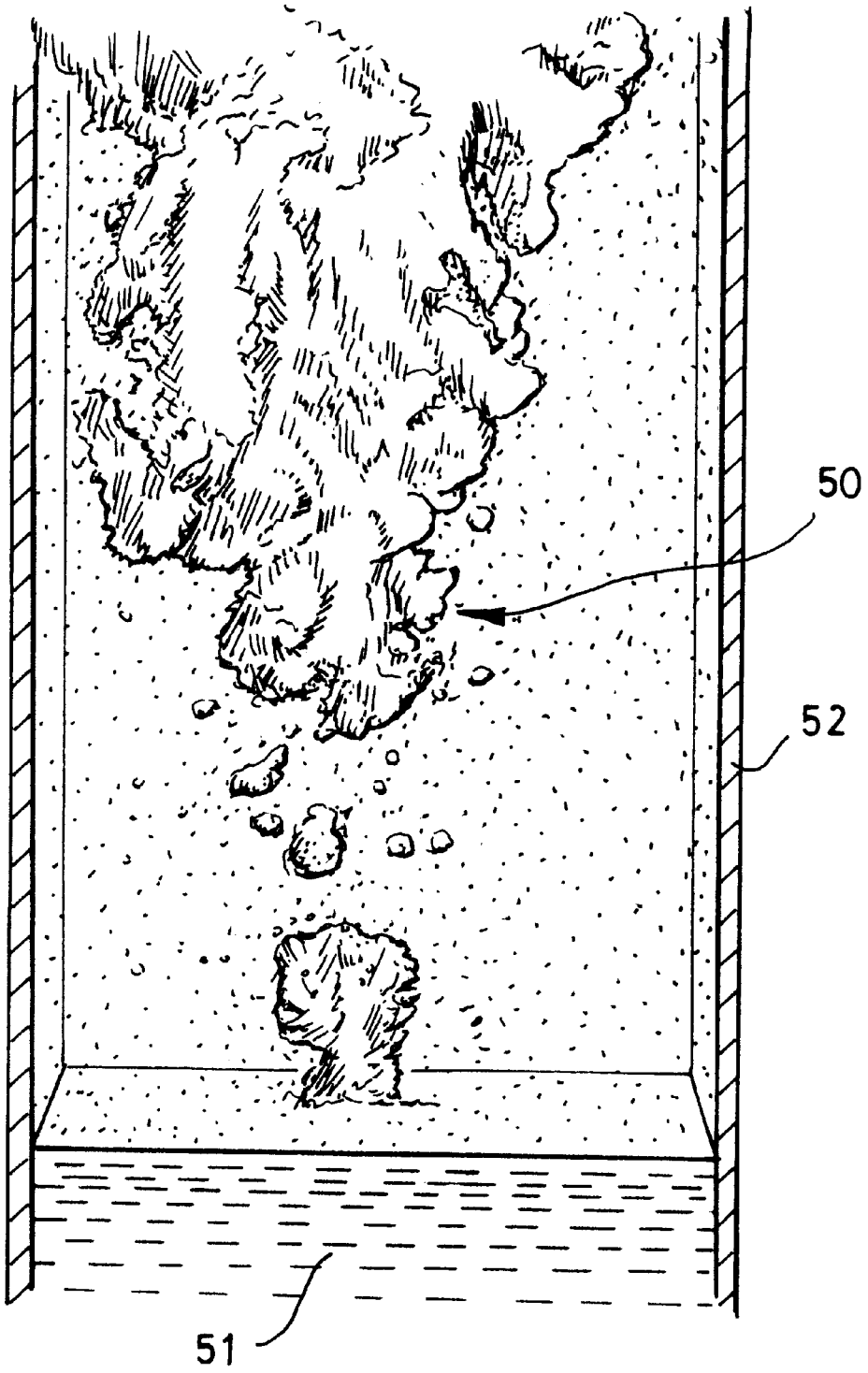
Figure 4E:
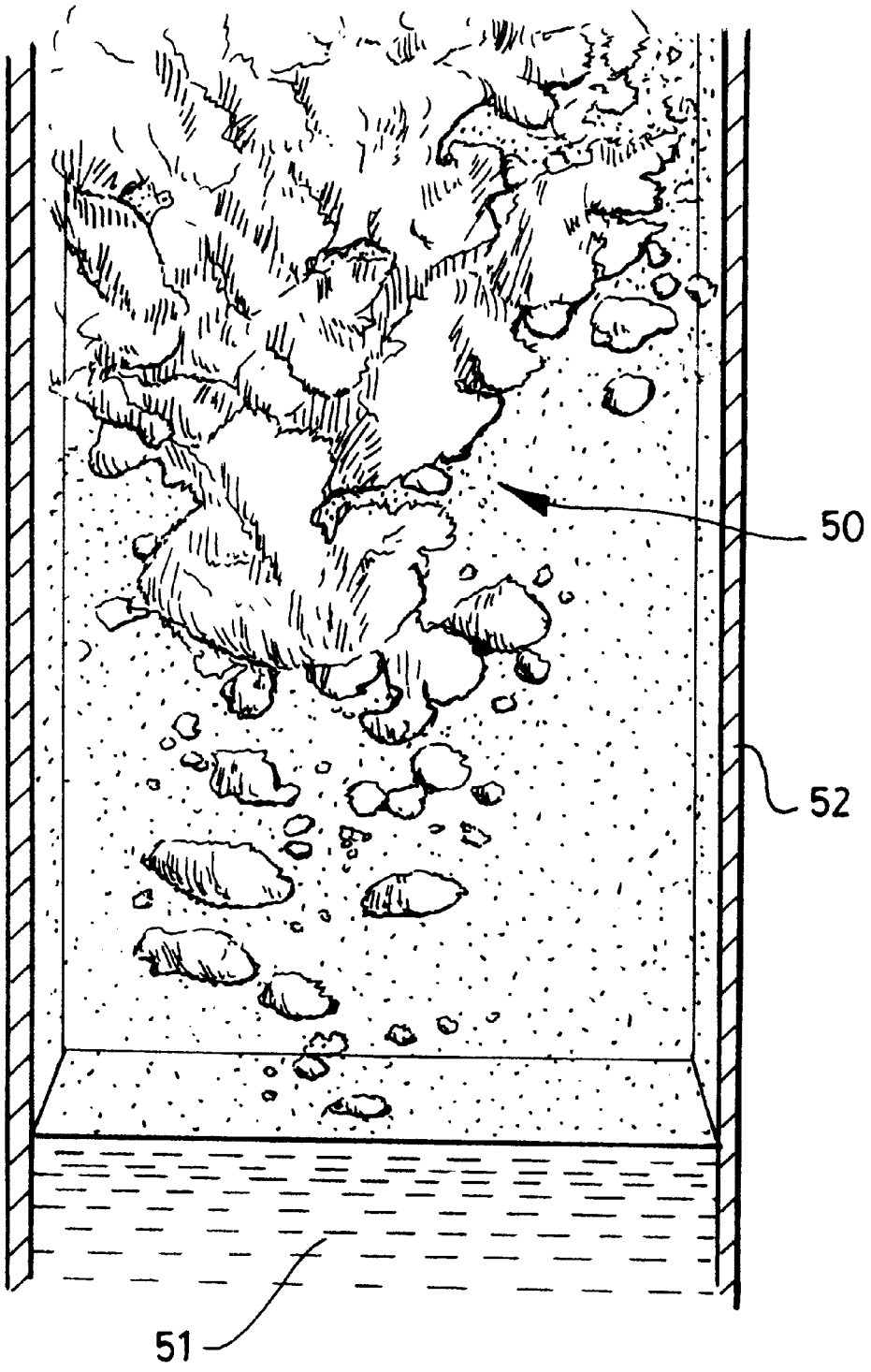
Figure 4F:
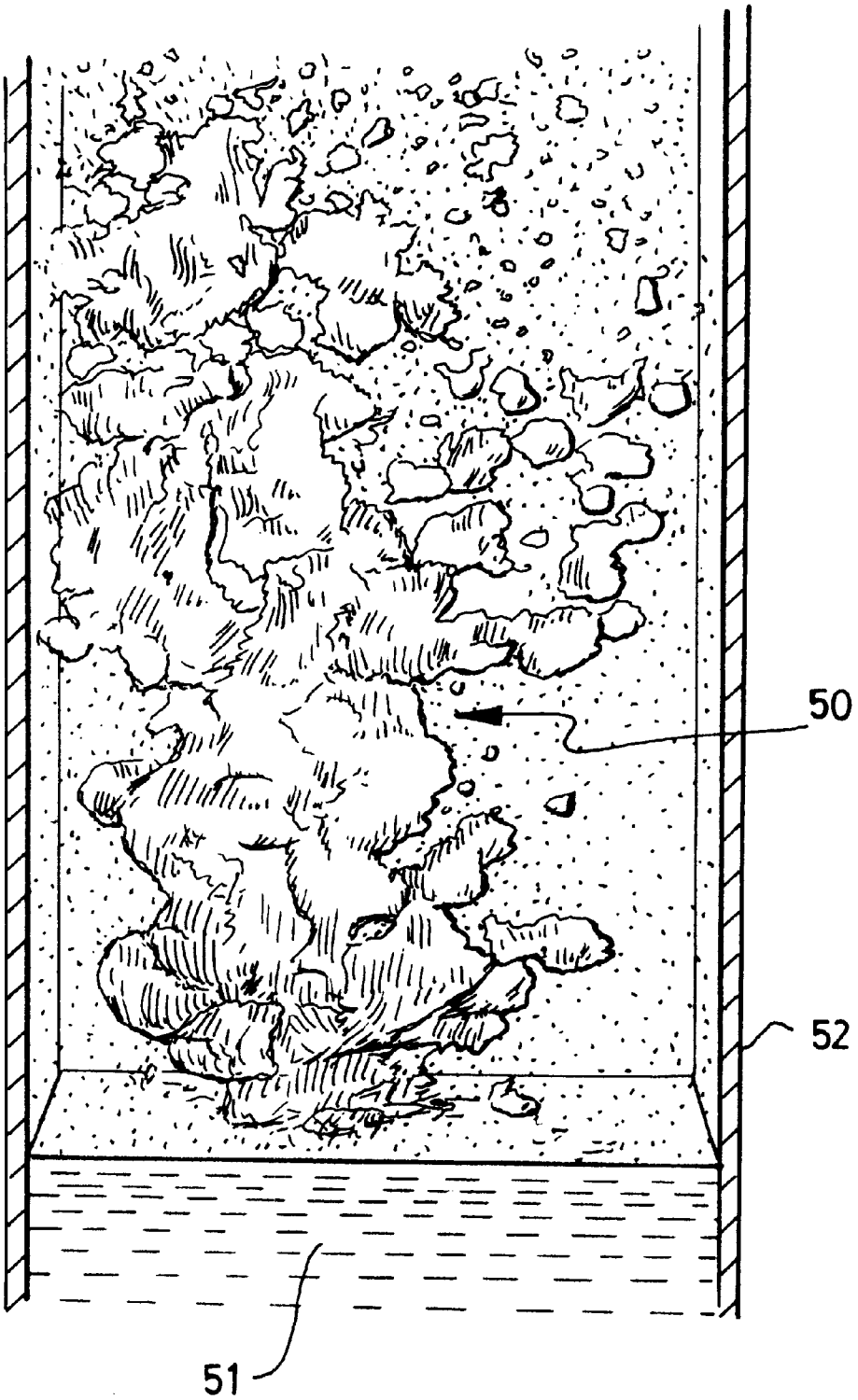
Figure 4G:
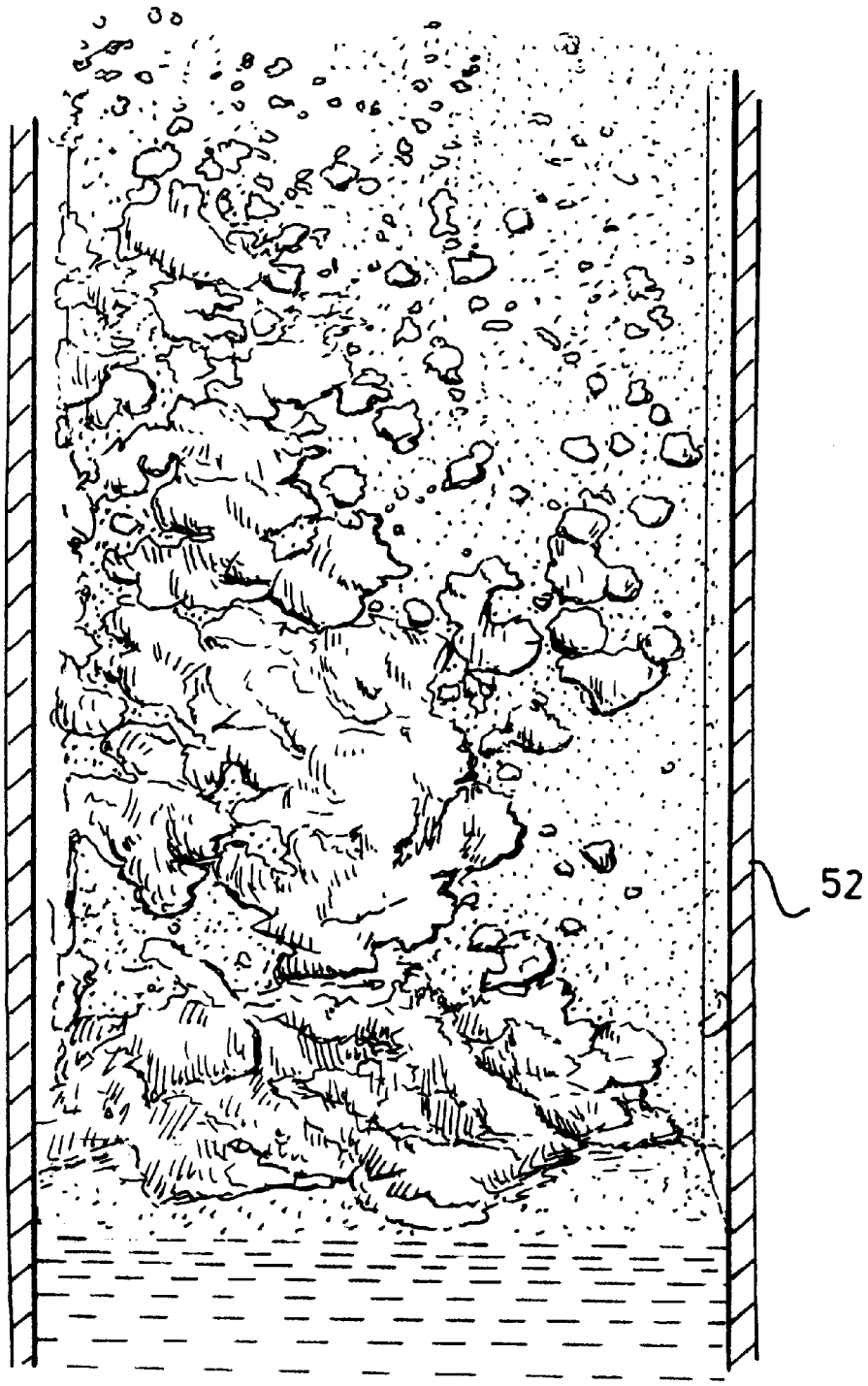
Figure 4H:
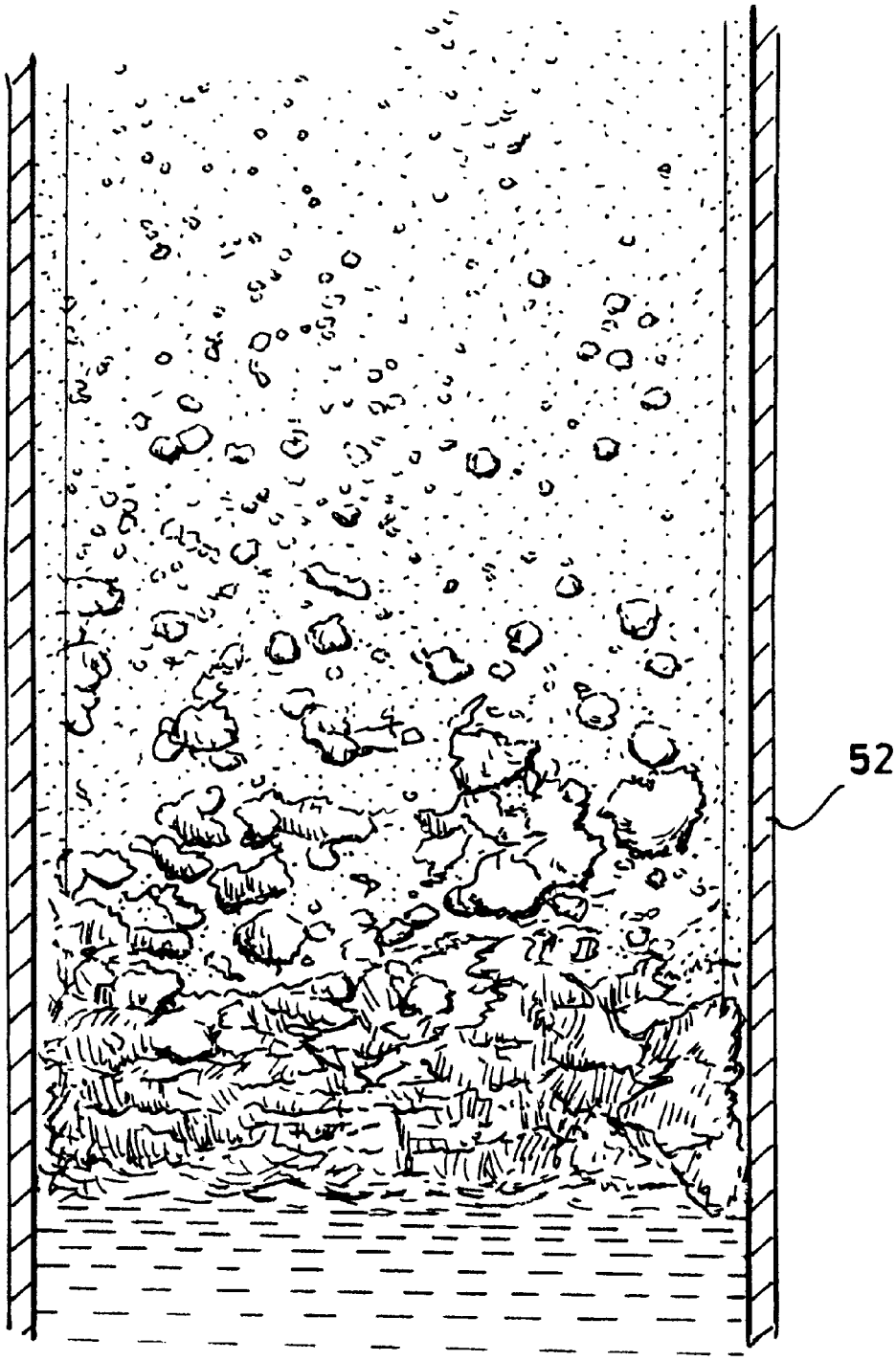

The alternative tool of FIG. 3B is a tool having its body in two distinct but substantially identical portions. Each portion utilises a centered tool assembly (35*l*, 35*r*) much like that of FIG. 3A, but each portion has a single tubular port extension arm (36*l*, 36*r*). In fact, each portion 35*l*, and 35*r* has two ports, but only one is shown; in one case one of those ports has the extension arm 36*l*, and 36*r* and the other port is blanked off, while in the other case it is the other of the ports that has the extension arm 36*l* and 36*r* (and "the one" port is blanked off).

The two portions 35*l*, and 35*r* are joined front-to-back to make a linear whole, and are associated with control packages, tracer material reservoirs and metering chambers, and solenoid-operated valves, not shown separately.

FIGS. 4*a*–4*h* show what happens when an oil-based marker is injected through a water/oil interface into the oil phase.

As illustrated in FIGS. 4*a*–4*h*, an oil based marker (50) is forcibly injected from within the water phase (51) shown at the bottom of the tank (52), upwards into the oil phase. The coloured marker fluid used has a kerosene base that is identical to the oil phase and totally miscible therewith. Furthermore, the marker fluid is not miscible in the water phase, and can therefore be expected, in conventional thinking, to migrate quickly into the oil phase. However, as can be seen this is not what happens at all.

The FIGS show a time-lapsed sequence of what happens to the marker material. After injection into the oil phase, shown progressively in FIGS. 4*a*–*c*, the marker breaks up into many balloon-like bubbles. These have been found to be coated with a thin film of water from water/oil interface, and this unexpected result causes the marker bubbles to repel instead of mix with the surrounding oil phase. In addition, the thin films of water forming the bubbles can have a high surface tension which can physically pull the bubbles down towards the water/oil interface, and further prevent any mixing with the oil phase. The water/oil interface acts like a strong elastic membrane that permits a limited encroachment of the marker material breaking through the interface, but has sufficient strength to capture the marker bubbles and eject them back into the originating phase.

These experimental results indicate that any injected marker material that is forced to pass through a two-phase interface may well not mix properly with the intended phase, and therefore will not measure correctly the velocity of either the selected phase or the total fluid.

What is claimed is:

1. A downhole flow-monitoring tool for monitoring the flow of multiphase fluid within a borehole, the tool including an injector for injecting tracer or marker material through at least two separated ports into a flowing fluid, wherein at least one port of said at least two ports is mounted on a structure extendable away from the main body of the tool, said at least one port having a channel to a material reservoir within said main body of said tool.

2. The tool of claim 1, wherein the at least one port is mounted on a structure permitting angular movement around the main body of the tool.

3. The tool of claim 1, wherein ports intended to inject tracer or marker material into different phases are connected in operation to separate material reservoirs.

4. The tool of claim 1, wherein the extendable structure includes spacer elements that in use stretch across the borehole, and wherein the ejection ports are located relative to those spacer elements such that when in position the ports will be appropriately disposed across the borehole.

5. The tool of claim 4, wherein the spacer elements are adjustable, so that they permit the tool to fit inside differently-sized boreholes and/or to pass through constrictions in a borehole.

6. The tool of claim 4, wherein at least one spacer element is a bow-shaped spring attached at one end to the tool and extending out and away therefrom and then curving back toward the tool.

7. The tool of claim 6, wherein the bow spring is mounted to the main body of the tool preventing axial movement while permitting angular movement of one end of said bow spring, while permitting axial and angular movement of the other end.

8. Method of monitoring the flow of multiphase fluid within a borehole, comprising the steps of injecting tracer or marker material through at least two separated ports into a flowing fluid in a first borehole region; and detecting said tracer or marker material in the flowing fluid at a second downstream borehole region, wherein the step of injecting said tracer or marker material includes the steps of positioning said ports into different phases of said flow and injecting traces or marker material directly into said different phases.

9. The method of claim 8, wherein different tracer or marker material is used for injection into different phases.

* * * * *